United States Patent [19]
Graham, Jr. et al.
[11] 4,317,547
[45] Mar. 2, 1982

[54] TRANSFER PAPER TOWEL DISPENSER

[75] Inventors: Andrew S. Graham, Jr., Wyncote; Coleman D. Berg, Philadelphia, both of Pa.

[73] Assignee: Fleck Industries, Inc., Willow Grove, Pa.

[21] Appl. No.: 166,751

[22] Filed: Jul. 7, 1980

[51] Int. Cl.[3] ..... B65H 19/04
[52] U.S. Cl. ..... 242/55.3; 242/55.53
[58] Field of Search ..... 242/55.3, 55.53; 225/16; 83/345; 312/39-41, 38, 37

[56] References Cited

U.S. PATENT DOCUMENTS

| | | | |
|---|---|---|---|
| 2,930,664 | 3/1960 | Liebisch | 312/39 |
| 3,217,953 | 11/1965 | Bahnsen | 225/16 |
| 3,628,743 | 12/1971 | Bastian et al. | 242/55.3 |
| 3,653,733 | 4/1972 | Wyant | 312/39 |
| 3,917,191 | 11/1975 | Graham, Jr. et al. | 242/55.3 |
| 4,010,909 | 3/1977 | Bastian | 242/55.3 |
| 4,137,805 | 2/1979 | De Luca et al. | 83/345 |
| 4,165,138 | 8/1979 | Hedge et al. | 312/39 |

*Primary Examiner*—Leonard D. Christian
*Attorney, Agent, or Firm*—Kenneth P. Synnestvedt

[57] ABSTRACT

A transfer towel dispenser for sequentially delivering toweling from a primary roll in a first station and from a secondary roll in a second station, provision being made for mounting the primary roll in the first station with freedom for shifting movement, and including transfer mechanism for transferring the web fed from the primary roll to the secondary roll, the transfer mechanism being connected with the shiftable mount for the primary roll and triggered by shifting movement of the primary roll and its support upon exhaustion of the web being delivered from the primary roll.

15 Claims, 12 Drawing Figures

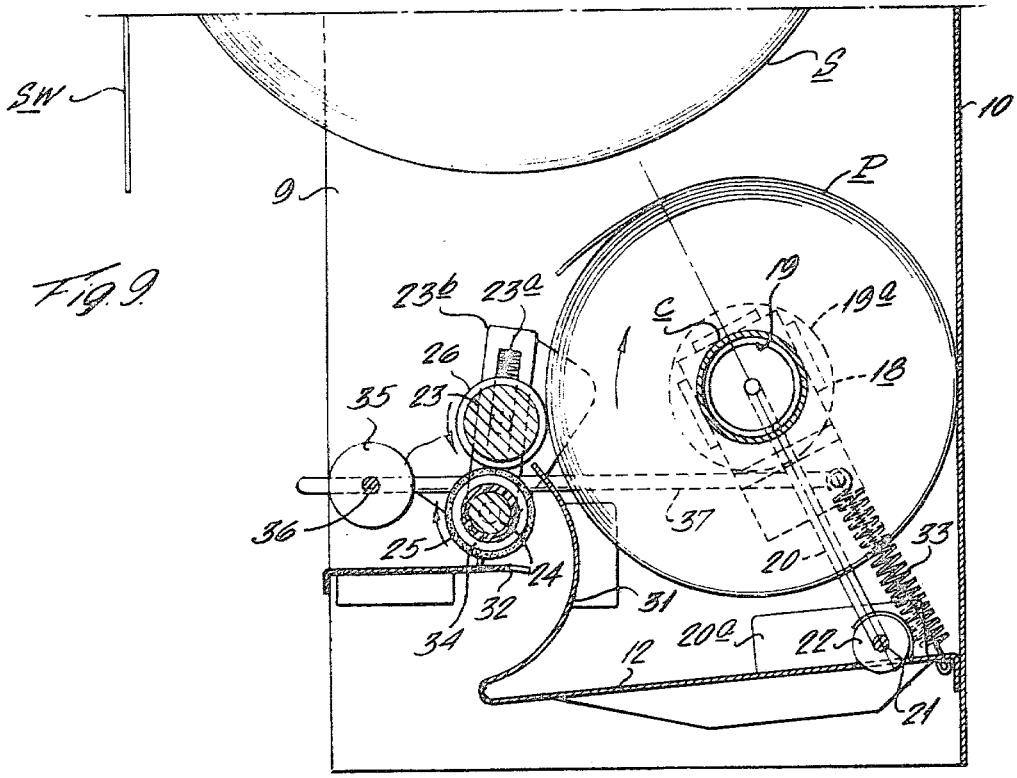
Fig. 9.
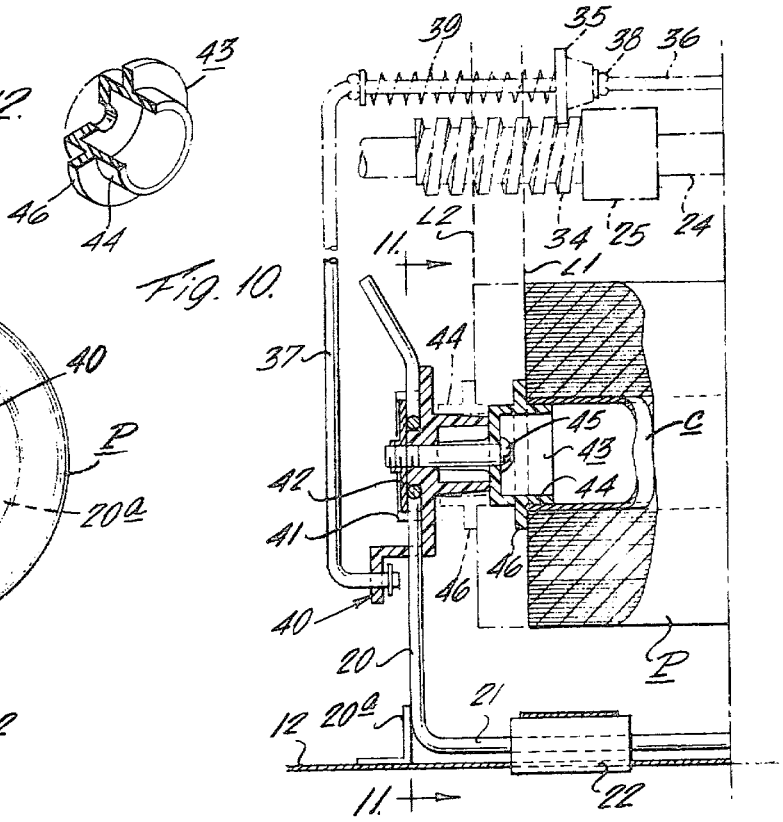
Fig. 10.
Fig. 12.
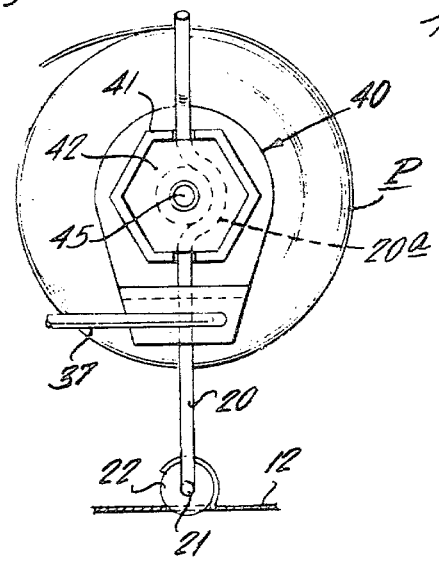
Fig. 11.

TRANSFER PAPER TOWEL DISPENSER

BACKGROUND AND STATEMENT OF OBJECTS

The invention is concerned with paper towel dispensers, particularly dispensers adapted to accommodate a primary roll in a first station and a secondary roll in a second station, with provision for transfer mechanism automatically operative to feed toweling sequentially from the primary roll and then from the secondary roll upon exhaustion of the primary roll.

Although the invention is particularly concerned with certain features of construction for mounting the rolls and for effecting the transfer in a paper toweling dispenser, it is to be understood that various of the features are applicable to dispensers for other continuous webs, for instance, toilet tissues or any other web supplies involving primary and secondary sources from which it is desired to effect the feed sequentially, first from the primary supply and then from the secondary supply. Since the invention is of special utility in the field of paper towel dispensers, such as those commonly installed in toilet rooms, the invention is herein illustrated and described as applied to an embodiment of a paper towel dispenser.

As is known, transfer dispensers commonly are enclosed in a cabinet and incorporate two roll accommodating stations, one of which is herein identified as the primary roll station, and the other as the secondary roll station. The general purpose of this configuration is to facilitate janitorial maintenance while at the same time assuring constant availability of toweling supply. In a typical embodiment, the roll in the primary station has only a minor fraction of the total toweling initially included in that roll, and the web from the primary roll is threaded through the feed mechanism and is discharged or delivered from the dispenser, frequently by the turning of a handcrank or actuation of a lever. The second station, provided for the secondary roll, accommodates a fresh or full roll which remains as a reserve supply in the dispenser until the web from the primary roll is exhausted.

When the attendant or service personnel inserts a new roll in the secondary station, the roll which had previously occupied that position is first shifted to the primary station, the web of this roll remaining in engagement with the feed mechanism; and then the web of the secondary roll is brought into a position near the feed mechanism, but not in engagement therewith. In transfer dispensers, provision is made for introducing the web of the secondary roll into the feed mechanism either toward the end of the feed of the web from the primary roll or after complete exhaustion of the primary roll web.

Several different forms of dispensers of the general type referred to above are known, but certain types of problems arise with various of the prior known dispensers. For example, in some cases, the transfer of feed from the primary roll to the secondary roll has a tendency to occur prior to complete exhaustion of the paper web from the primary roll, with consequent concurrent delivery of both webs during the feed of the final portion of the primary roll web. This represents a waste of paper, and the arrangement of the present invention is adapted to assure that the feed of the web from the secondary roll does not occur until complete or at least substantially complete exhaustion of the web from the primary roll.

In some of the prior dispensers, the transfer operation is unreliable at least from time to time; and in consequence, in some cases, the primary roll web is exhausted and the secondary roll web is not delivered at the time of exhaustion of the primary web. Another objective of the present invention is to greatly increase the reliability of the transfer function.

In some instances in prior arrangements, the transfer mechanism has been arranged to engage the web in only a single relatively limited region transversely of the secondary roll web between the side edges thereof; and in some cases where the leading end of the secondary roll web has been torn off or folded under in the region where the transfer mechanism would normally operate, the transfer would be unreliable or might fail. It is an object of the present invention to overcome problems of this type, particularly by providing more than one transfer device respectively engageable with the web of the secondary roll in spaced retions thereof, preferably adjacent to each side edge thereof. In this way, if one edge or corner piece of the web from the secondary roll is torn off or folded under, the transfer will be effected by the transfer mechanism associated with the outer edge of the web.

Still further, in some prior arrangements, there is a tendency under certain conditions for the transfer mechanism to be prematurely triggered. Sometimes, this can happen as a result of an impatient towel user delivering a manual blow to the cabinet, and thereby jarring internal parts to such an extent as to prematurely trigger the transfer. It is also an objective of the present invention to positively assure against premature triggering of the transfer mechanism at least until a point representing substantial exhaustion of the primary web.

It is another object of the invention to provide an arrangement which limits the size of the secondary or reserve roll which may be transferred to the primary roll station at the time the dispenser is serviced.

Still another object of the present invention is to provide a roll-mounting structure, especially adapted for use in the station for the primary roll, such structure being arranged to provide for alternative support of rolls of paper webs of different width.

BRIEF DESCRIPTION OF THE DRAWINGS

How the foreging general objectives of the invention are achieved, and various other advantages thereof, will appear more fully from the following description referring to the accompanying drawings, in which:

FIG. 9 is a view similar to FIG. 5 but illustrating the action of the dispenser in limiting the size of the secondary roll which may be inserted into the primary station; and FIGS. 10, 11 and 12 are views of a mounting device for rolls in the primary station, this view showing an alternative embodiment as compared with FIG. 4, and providing for accommodation of rolls of different length.

DETAILED DESCRIPTION

Figure 1:
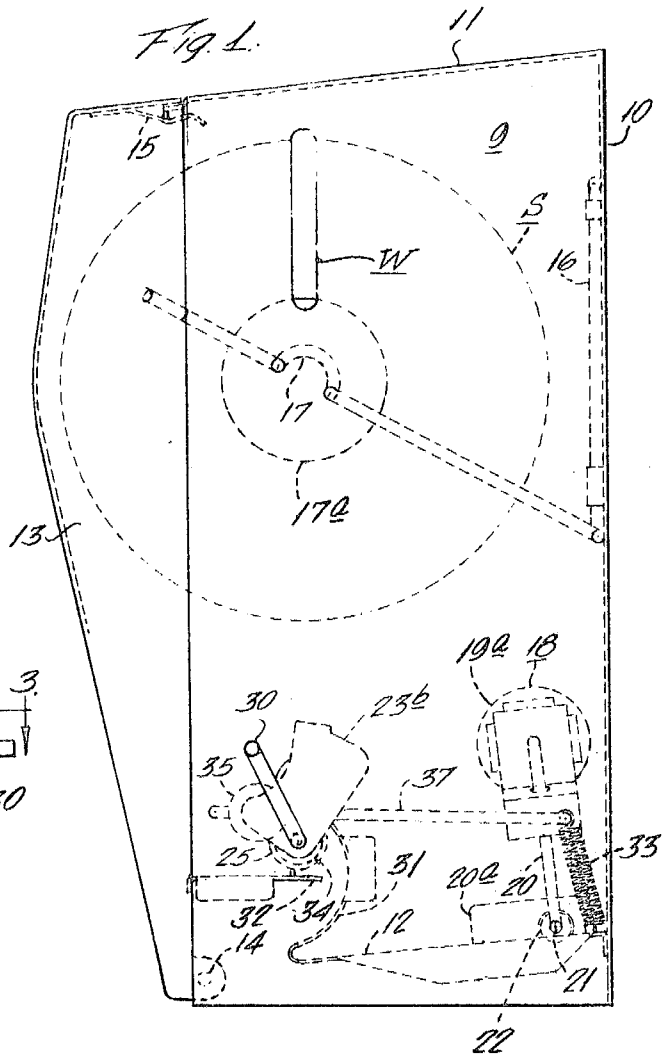
FIG. 1 is an outlined elevational view from a side of a towel dispensing cabinet arranged in accordance with the present invention, with certain of the internal parts illustrated by dotted lines.

Although the mechanism of the present invention may be mounted on any desired type of supporting structure, in a typical case, the mechanism is mounted within a cabinet having a displaceable closure, and an example of such a cabinet is illustrated in the drawings. The cabinet shown has side walls 9—9, a back wall 10, a top wall 11 and a bottom wall 12. The front of the cabinet is open but has a cover or closure member 13 which may be variously arranged, but which, as shown in FIG. 1, is hinged to the side walls 9 as indicated at 14, being provided with a releaseable latch 15 at the upper edge, so that for replacement of the secondary roll, the cabinet may be opened for convenient access at the front.

The secondary or reserve roll, such as indicated at S, is mounted in the secondary roll station by means of mounting brackets here shown as formed of bent wire pieces 16 mounted on the back wall 10 of the cabinet, with portions thereof bent, as indicated at 17, in the form of bearing supports for engaging in the end openings of the core SC of the secondary roll S. The supports carry abutment discs 17*a* adapted to engage the end of the roll. The specific configuration of the secondary roll mounting parts form no part of the present invention per se, and these parts may be otherwise constructed, so long as they provide for the support of the secondary or reserve roll in the secondary station, preferably in the upper region of the cabinet.

In typical maintenance procedure, after a substantial amount of the secondary roll web has been depleted, the secondary roll is moved into the primary station. The primary station is provided by a pair of supporting devices, one form of which appears in FIG. 4, being identified by the numeral 18 carrying a journal part 19 adapted to engage in the end of the roll core C and an abutment disc 19*a* adapted to engage the end of the roll when the roll is moved to the primary roll station. The journal devices 18 are mounted by means of arms 20 which extend downwardly to a point close to the bottom wall 12 of the cabinet and which are pivotally mounted, as indicated at 21, in the bearing supports 22. Positioning brackets 20*a* mounted on the bottom wall 12 serve to maintain the arms 20 in the desired lateral position.

Figure 2:
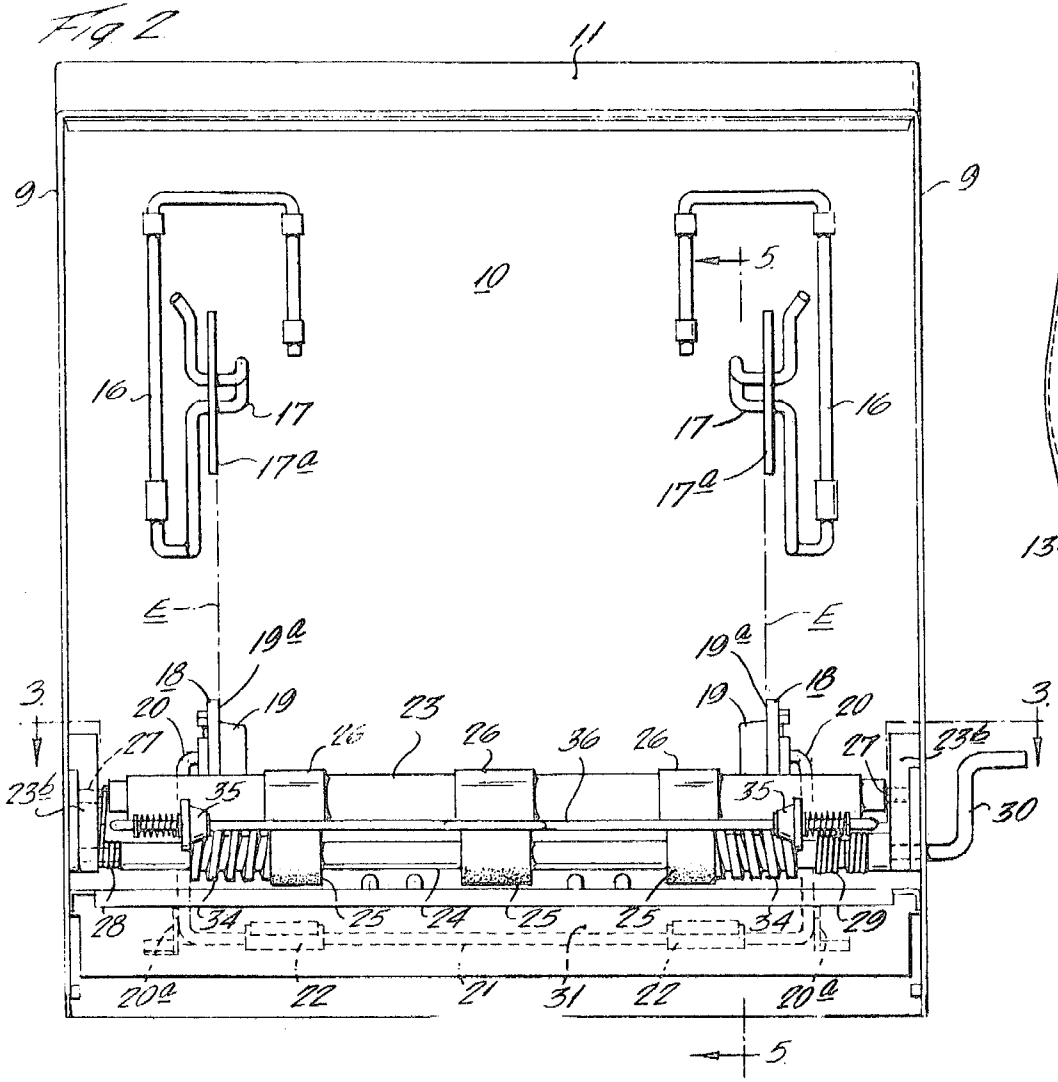
FIG. 2 is a front elevational view of the cabinet shown in FIG. 1 with the front closure of the cabinet removed in order to disclose many of the parts lying within.
Figures 3, 4:
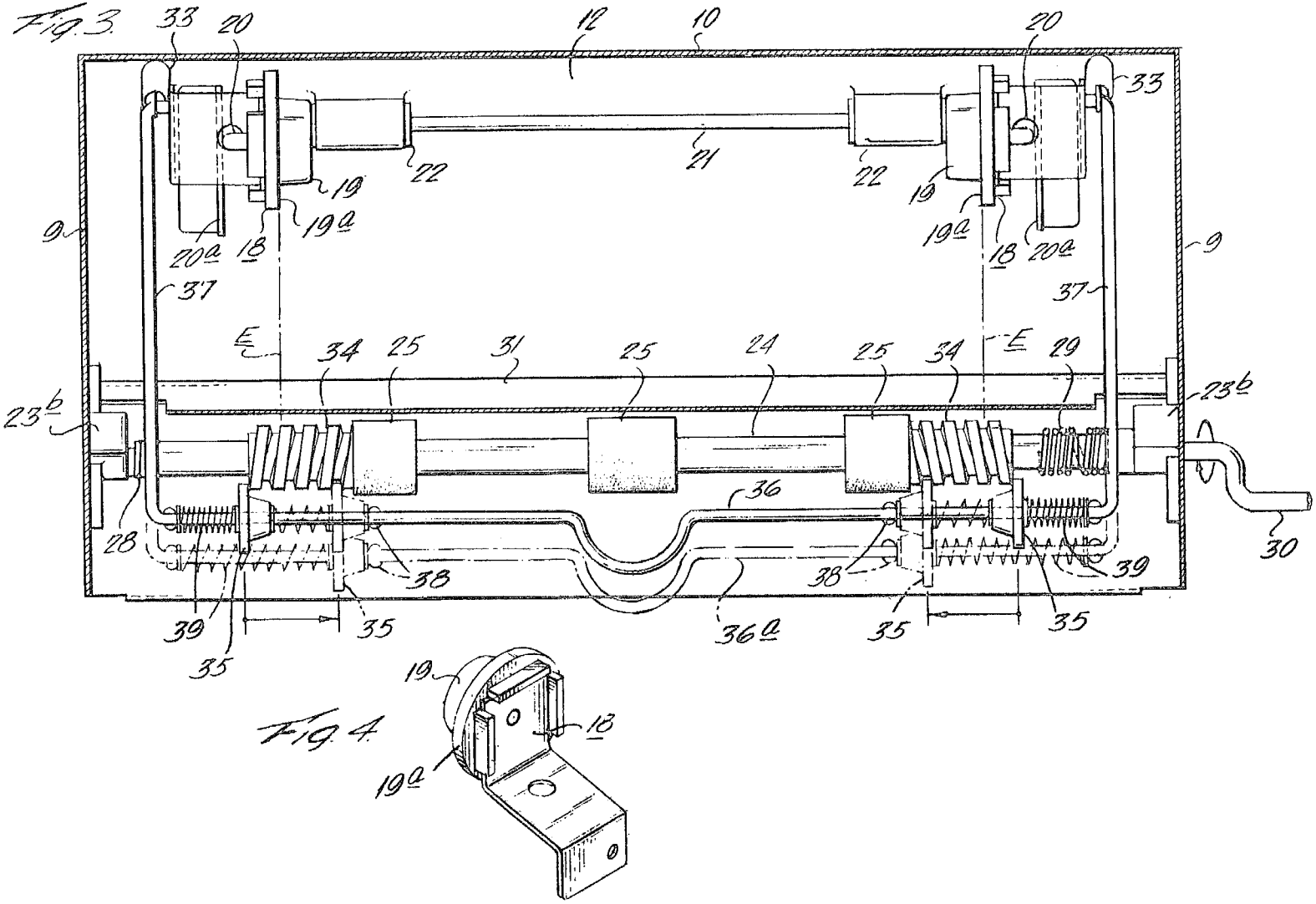
FIG. 3 is a horizontal sectional view through the cabinet and illustrating many of the internal operating parts in elevation, this view being taken as indicated by the section line 3—3 on FIG. 2, but being enlarged as compared with FIG. 2.
FIG. 4 is an isometric view of one form of mounting devices employed for mounting the primary roll in the first station.
Figure 5:
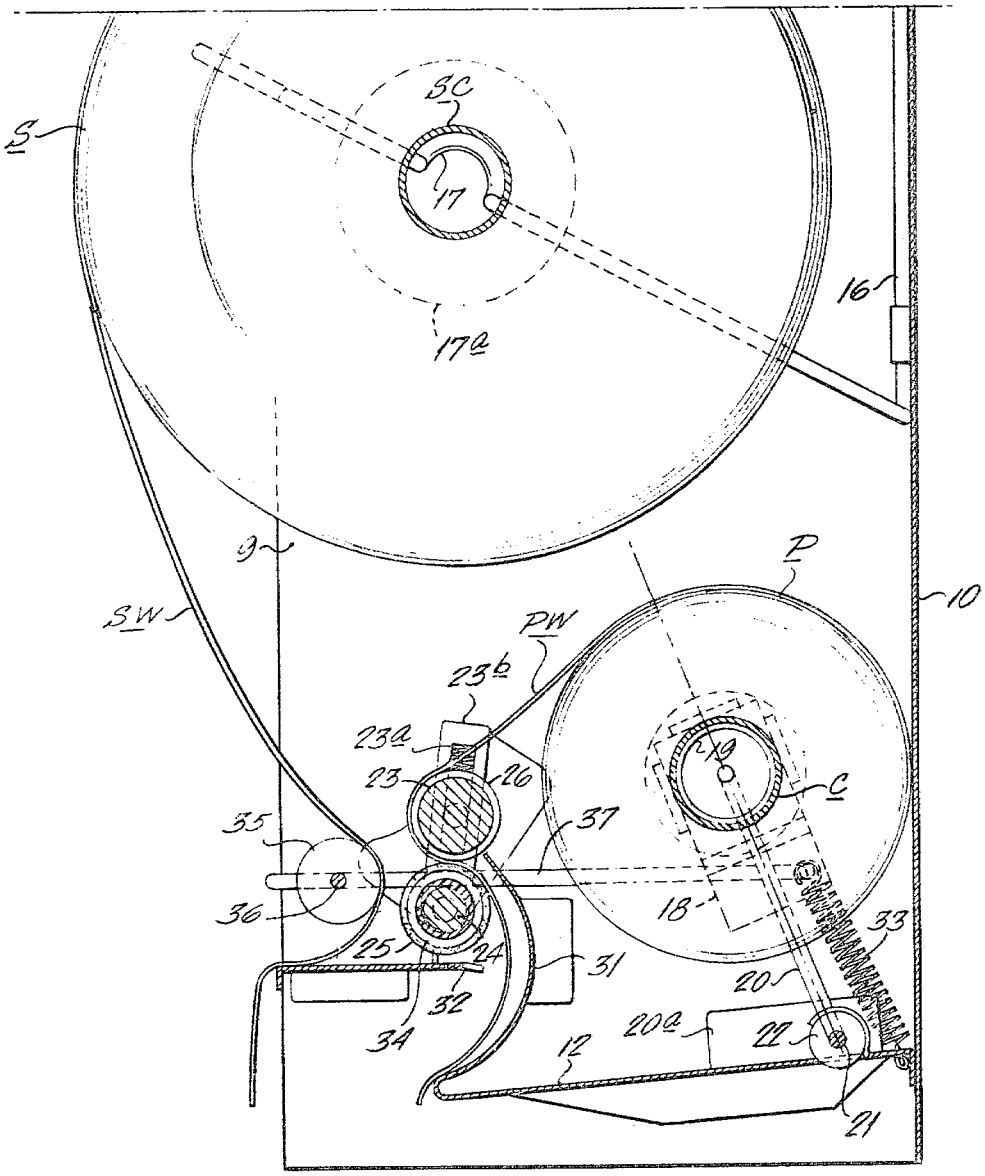
FIG. 5 is a transverse vertical sectional view through the cabinet and various of the internal parts, this view being taken as indicated by the section line 5—5 on FIG. 2 and being enlarged as compared with FIG. 2, and this view showing the positioning of the primary and secondary rolls and other parts immediately following a typical servicing of the cabinet, at which time a partly used secondary roll is shifted from the secondary station to the primary station and also at which time a new secondary or reserve roll is inserted in the secondary station.

A primary roll in the first station (after having been transferred from the secondary station to the primary station) is indicated in various of the figures by the letter P; and when initially inserted in the primary station, the parts typically occupy the positions indicated in FIG. 5. From FIG. 5, it will be seen that the primary roll web PW is extended from the top of the roll P toward the feed mechanism, which comprises a pair of shafts 23,24. Referring particularly to FIGS. 2, 3 and 5, it will be seen that the shaft 24 carries spaced cylindrical driving surfaces 25 adapted to cooperate with the cylindrical drive surfaces 26 formed on the upper shaft 23. The upper shaft 23 is journalled at its ends in fittings 23*b*, as indicated at 27. Toward the left, as viewed in FIGS. 2 and 3, the lower shaft 24 is also journalled in the fitting indicated at 23*b* at the left end. Toward the right hand end of the shaft 24, as viewed in FIGS. 2 and 3, the shaft 24 extends into a helical spring clutch of known type indicated at 29. The clutch 29 serves to drivingly interconnect the handcrank 30 with the shaft 24; and the interconnected parts are journalled in the fitting 23*b*. This handcrank serves the purpose of dispensing or feeding the toweling from the dispenser cabinet. When the handcrank is rotated in the direction to feed the paper, the clutch engages and transmits the rotation to the shaft 24. In the event of incorrect reverse rotation of the handcrank, the frictionally operating helical spring 28 automatically tightens and prevents the reverse rotation.

For the purpose of increasing the frictional engagement of the pairs of driving surfaces 25–26, each surface 25 is preferably formed of a material having a relatively high coefficient of friction, such as rubber. The surfaces 26 need not necessarily be formed of high friction material; and in a typical embodiment, the shaft 23, including the drive surfaces 26, may conveniently be formed of wood. The two drive shafts 23 and 24 are urged toward each other by springs 23*a* (see FIG. 5) located within the vertical guide slots in the fittings 23*b* for journalling the drive shafts.

Referring further to FIG. 5, it will be seen that the web PW from the primary roll extends over the top of the feed roll 23 and then downwardly and rearwardly into the nip between the pairs of driving surfaces 25–26. The web is then guided by the guide element 31 downwardly for discharge from the lower region of the cabinet, and a serrated cut-off knife 32 facilitates tearing off the dispensed length of the toweling.

As above noted, the position of the parts illustrated in FIG. 5 represents the condition immediately following the manual shifting of a roll from the secondary station into the primary station; and attention is now directed to the fact that the springs 33 tend to pull the pivotal mounting arms 20 for the primary roll rearwardly in the cabinet, thereby bringing the periphery of the primary roll against the back wall 10 of the cabinet, as is shown in FIG. 5. In this condition, therefore, the back wall, in effect, serves as a limiting stop for the rearward swinging of the primary roll.

Turning now to the transfer mechanism, attention is first directed to FIGS. 2 and 3. From these Figures, it will be seen that there are three cylindrical drive surfaces 25 mounted on the shaft 24, and further that the two outboard surfaces 25 are located in positions spaced somewhat inwardly from the ends of the shaft 24, and thus also inwardly of the position of the marginal edges of towel web being fed, such edges being indicated by broken lines marked by the letters E,E in FIGS. 2 and 3. Outboard of each of the outer cylindrical drive surfaces 25, the shaft 24 carries a threaded device or section 34, the threaded sections being of sufficient length and being positioned to extend somewhat both beyond and inboard of the lines E,E representing the marginal edges of the web. For reasons which will be brought out hereinafter, the diameter of the threaded sections 34 on the shaft 24 is preferably smaller than the driving surfaces 25; and in addition, the outboard end portions of the shaft 24 extending beyond the threaded sections are preferably smaller in diameter than the base of the threads in the sections 34.

The threaded sections above referred to cooperate with transfer elements which are best seen in FIG. 3. The transfer elements comprise rotative rollers 35,35 which are mounted for free rotation on the shaft 36, which extends across the dispenser and which has end portions forming links 37,37 which project rearwardly to and are fastened to the pivotted roll supports 18. In view of this mounting of the follower or transfer rollers 35, the transfer rollers move forwardly or rearwardly with the pivotal motion of the arms 20 supporting the primary roll P.

Each of the follower or transfer rollers 35 is mounted for shifting movement along the support 36 between an inner position defined by the limiting stop 38, and a position just outboard of the outer end of the associated threaded section 34. A helical compression spring 39 urges the roller 35 inwardly against the stop 38; and in this position, the roller is located so that movement of the links 37 rearwardly will bring the roller into engagement with the thread of the threaded section 34, whereupon the roller acts as a follower during rotation of the threaded section under the influence of rotation by the handcrank 30. The threads of the threaded sections 34 at opposite ends of the shaft 24 are of opposite hand and so arranged that upon rotation of the crank 30 in the direction to feed the paper web through the feed nip, the follower rollers 35 are caused to move outwardly toward the outer ends of the shaft 24 beyond the threaded sections; and at this time, the follower rollers 35 will ride upon the smaller diameter outer end sections of the shaft 24 during the dispensing or feed of the last portions of the primary roll web. The follower rollers 35 will remain in this outer position until the mounting shaft 36 is again displaced to the position indicated at **36*a* in FIG. 3, at which time the rollers will again be moved inwardly toward each other by the springs 39. As shown, the threads of the sections 34 and the rollers 35** are of angular or square shape, thereby minimizing tendency for the rollers to creep out of the threads and slip from one groove of the thread to another groove.

As will be seen from FIG. 5, in the initial position of the parts after a primary roll P has been positioned in the primary station, the follower or transfer rollers 35 are maintained out of engagement with the threaded sections 34, this position being indicated not only in FIG. 5, but also by the dot and dash line position **36*a* of the mounting shaft 36 and the dotted position 35*a* of the rollers 35, as applied to FIG. 3**.

With this position of the parts, immediately after the primary roll has been inserted in the first or primary station, when a new reserve or secondary roll is placed in the cabinet, the web SW of the secondary roll is readily threaded downwardly behind the shaft 36 and the follower rollers 35, but in a position not in frictional engagement with the pairs of driving surfaces 25–26.

Figure 6:
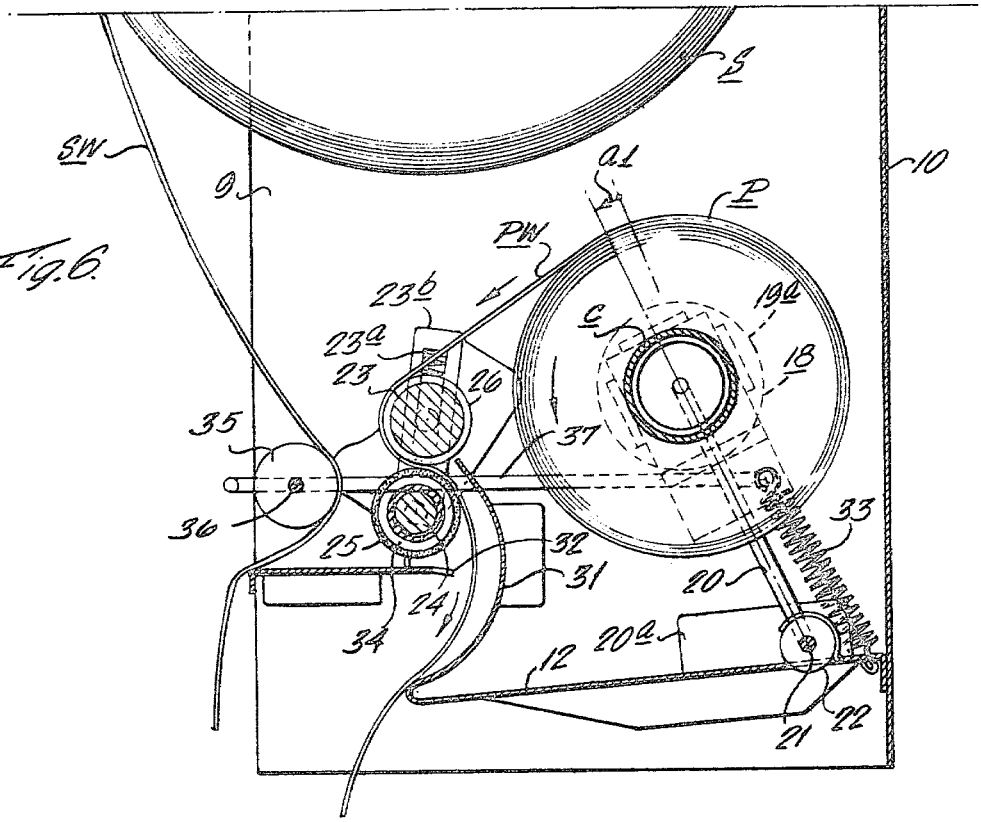
FIGS. 6 and 7 are views similar to FIG. 5 but showing only portions of the mechanism and illustrating different conditions of operation, as will be explained.

Turning now to FIG. 6, in normal use of the dispenser, the toweling web PW will continue to be drawn from the primary roll P; and this action will tend to tilt the pivotted mounting arms 20 for the primary roll forwardly as shown in FIG. 6 (see displacement arrow a1), thereby causing the links 37 to displace the follower rollers 35 still farther away from the shafts 23,24, as compared with the position shown in FIG. 5.

Figure 7:
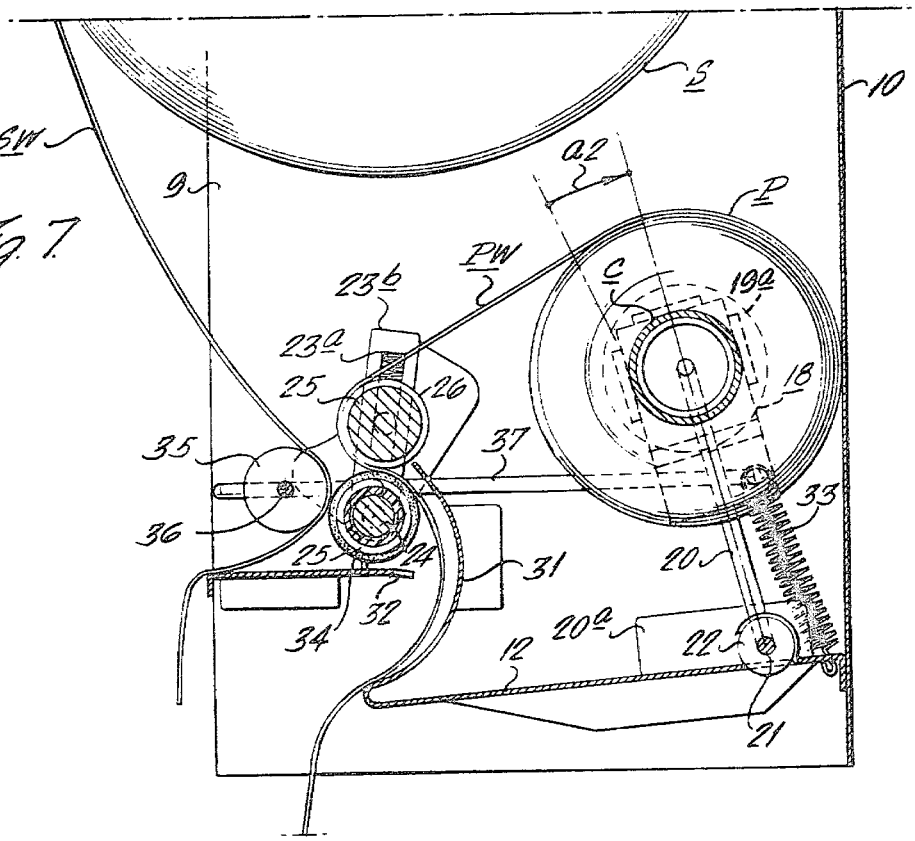

From comparison of FIGS. 6 and 7, it will be seen that even after some additional portion of the web has been delivered from the primary roll P, and even in the event of tendency for the primary roll to swing rearwardly on its supporting arms 20 (see displacement arrow a2), for instance as a result of jolting of the cabinet or some other action, the periphery of the primary roll P will still come into engagement with the rear wall 10 of the cabinet under the influence of the springs 33 prior to the time when the transfer rollers 35 would engage the threaded sections 34. Therefore, the mounting of the primary roll P by means of the arms 20 positively precludes the transfer action until the primary roll is close to exhaustion. Moreover, as the primary roll approaches exhaustion, the tension in the primary roll web PW becomes increasingly effective to maintain the pivotal supports 20 for the primary roll in the forward position (similar to that shown in FIG. 6). The reason for this is that as the primary roll is depleted, the radius at which the tension in the web PW is applied to the primary roll progressively decreases. This, in turn, results in a given amount of tension in the web being more effective in maintaining the mounting arms 20 in the forward position. This differential action is of greater effect than the increase in the opposing force of the springs 33. Being helical tension springs, the increase in the pull of the springs is relatively small.

Still further, the arrangement of the parts, including the mounting of the primary roll so that the web PW is drawn from the roll at the side thereof opposite to the pivot axis 21 for the arms 20, also results in maximizing the tendency for the feed tention in the web PW to maintain the arms 20 in their forwardly inclined position, i.e., the position in which the follower rollers 35 are maintained out of engagement with the threaded sections 34.

Various of the factors above cooperate in providing two important conditions tending to minimize undesired or premature transfer. First, the transfer is positively precluded by engagement of the primary roll with the back wall of the cabinet (the back wall acting as a limiting stop) until the primary roll approaches exhaustion. Second, the pivotal mounting of the primary roll and the path of feed of the web from the primary roll to the feed mechanism provides progressive increase in the forces tending to inhibit transfer until the point of actual exhaustion of the primary roll web. At the time of actual exhaustion of the primary roll web, the parts are caused to assume the condition indicated in FIG. 8 (see displacement arrow a3). Here it will be seen that the web PW of the primary roll has run out and the trailing end has dropped from the core C of the primary roll. Because of the exhaustion of the primary roll web, the tension in that web is no longer acting to pull the roll supports 18 forwardly, and the pivotal arms 20 are, therefore, drawn rearwardly by the springs 33. Consequently, the links 37, carrying the follower rollers 35, have been drawn rearwardly to bring the rollers into the threaded sections 34, and thereby the web SW of the secondary or reserve roll is caused to enter the feed mechanism. Initially, the feed rollers 35 engage the threads of the sections 34 in the marginal edge portions of the secondary web SW and the engagement of the rollers 35 with the threaded sections 34 with the web therebetween tends to apply a lateral spreading force to the web as the web enters the feed mechanism.

The use of follower or transfer elements, such as the rollers 35, at each side of the cabinet positioned to engage the opposite edge portions of the reserve roll web, assures the desired transfer, even in conditions where one corner or section of the reserve roll web is folded under or torn off, so that this transfer mechanism is more reliable than certain prior devices having only a single transfer mechanism.

After some of the secondary or reserve roll web has been dispensed (the progress of which may be observed through the slot or window W in the side wall 9—see FIG. 1), the servicing of the dispenser may proceed and, normally, would involve the removal of the empty core C from the primary roll station and, thereafter, the positioning of the reserve roll in the primary roll station, as in FIG. 5, in accordance with the above description. Also, at that time, a new secondary or reserve roll is inserted in the secondary station.

FIG. 9 illustrates a primary roll of maximum admissible size at the time of shifting of the reserve roll into the primary station. Here it will be seen that the roll P, which has just been shifted, has a diameter approximating the spacing between the back wall 10 of the cabinet and the drive surfaces 26 on the drive shaft 23. In effect, the drive shaft 23 and the back wall 10 act as limiting stops. The shifting of the roll into the primary station also results in forward displacement of the follower rollers 35 in the manner described above. Moreover, because of this arrangement, in the event that an attempt is made to force an oversized roll into the primary station, the frictional engagement of the periphery of the roll with the drive shaft 23 will have a tendency to displace the oversized roll. The reason for this is that the normal direction of manual rotation of the drive shafts 24 and 23 is such that the engagement of the periphery of the roll with the shaft 23 would tend to lift the forward side of the roll, and thereby relieve a jamming action.

It will also be noted from FIG. 9 that the maximum size of the roll, which is admissible into the primary station, is such that the periphery of a new reserve roll is spaced from the periphery of the primary roll.

Although the drive shaft 23 serves to limit forward motion of the primary roll when a reserve roll of maximum size is shifted into the primary station, as the web of the primary roll is dispensed and the diameter of the roll decreases, forward swinging movement of the mounting arms 20 of the supports for the primary roll will be limited by engagement of the periphery of the primary roll with the rear surface of the guide element 31. For example, with a roll diameter as shown in FIG. 7, the periphery of the primary roll P would engage the guide element 31, rather than the drive shaft 23. Excessive swinging movement of the primary roll supports (induced for example by some abnormal tension condition) is thus prevented.

The foregoing arrangement is highly effective in providing not only reliable transfer at the time when transfer is desired but also in preventing premature triggering of the transfer function.

All of the foregoing features are also involved in the embodiment illustrated in FIGS. 10, 11 and 12 in which similar parts are identified by the same reference characters. In this embodiment, provision is made for alternatively accommodating paper rolls having webs of different width. Thus, with the arrangement as shown in FIGS. 10 to 12, a primary roll P having a web width indicated by the broken line L1 may be mounted and dispensed in the dispenser or, alternatively, a somewhat wider web roll indicated by the broken line L2 may be mounted and dispensed. With rolls of webs of either of these dimensions, the edges of either one of the webs will overlie the threaded portion 34 of the drive shaft 24, so that the same transfer roller elements 35 and the same transfer mechanism is useable alternatively with rolls and webs dimensioned as indicated by the broken lines L1 and L2.

For the purpose of alternatively mounting rolls of different length, the primary roll supports 40 in the embodiment of FIGS. 10 to 12 are provided with angularly shaped sockets 41 adapted to receive correspondingly shaped elements 42 which serve as fastening devices for roll supports indicated generally at 43. One such roll support appears in perspective in FIG. 12, with a portion broken out, and it will be seen that this device has a cup-shaped portion 44, the bottom wall of which is apertured to cooperate with the fastening screw 45 which is threaded into the element 42 at the outer side of the supporting device 40. When the roll supports 43 are positioned as indicated in full lines in FIG. 10, the open end of the cup 44 is presented inwardly and the flange 46 surrounding the outside of the cup is positioned so as to cooperate with the end of a roll lying in the plane indicated by the broken line L1. By inverting the position of the roll supports 43, so that they occupy the position indicated in dotted lines at 43*a* in FIG. 10, the external flange on the cup 44 lies in a different position, adapted to cooperate with the end of a roll lying in the plane indicated by the broken line L2. In either of these positions, the cup may be mounted and fixed on the supporting device 40 by means of the screw 45.

If desired, only one of the two roll supports 43 may be inverted, thereby providing for the accommodation of a roll having a paper web of a width intermediate to the two widths respectively accommodated by having both of the roll supports 43 in the same operative position.

From the aove, it will be seen that different length rolls may be accommodated in the same dispenser merely by inverting the position of one or both of the roll supports 43.

Figure 8:
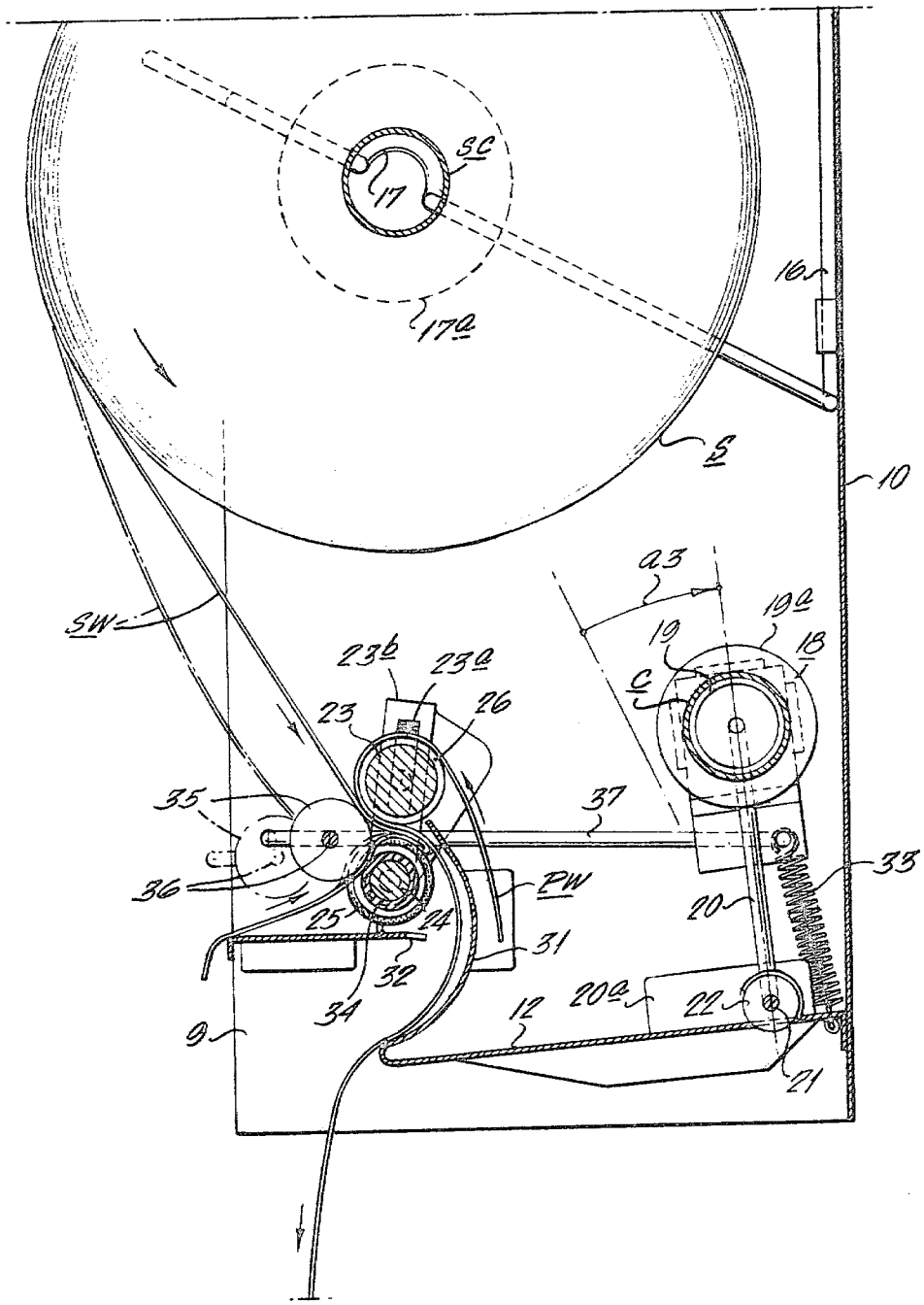
FIG. 8 is a view similar to FIG. 5 but illustrating the condition in the dispenser immediately following triggering of the transfer mechanism.

Since it is intended that the tension in the web PW of the primary roll should serve as a force tending to keep the primary roll supports in a position forward of that shown in FIG. 8, and thereby maintain the follower rollers 35 out of engagement with the threaded sections 34, the roll mounting parts for positioning the roll in the primary station, and particularly the pivotal arms 20, are constructed to apply some pressure through the roll support devices against the end of the paper roll in the region of the roll core. This provides frictional resistance to rotation of the roll and thereby establishes tension in the web PW when the drive shafts 23 and 24 are manually rotated to effect dispensing of the paper toweling. This is true with the type of handcrank drive shown at 30 in FIGS. 1, 2 and 3; but in addition, the same would also be true for any other manual means for rotating the drive shafts.

The removal of the core C of an exhausted roll from the primary station and the insertion of another roll by shifting a reserve roll into the primary station may readily be accomplished notwithstanding the pressure exerted against the ends of the roll by the roll supports, because the supporting arms 20 are formed of readily deflectable and resilient wire type components.

It is also noted that the wire type components 16–17, which are mounted on the back wall 10 for supporting the reserve roll in the secondary station, may also readily be deflected sufficiently to facilitate removal and insertion of rolls in the secondary station. Moreover, even where the invertable type of roll supports 43, shown in FIGS. 10 to 12, are used in the primary station to accommodate rolls of different length, the proportioning of the wire type elements 16–17 for supporting a reserve roll in the secondary station may readily accommodate rolls of different length, within the range of such different lengths as typically used in the paper toweling industry.

I claim:

1. A towel dispenser for sequentially feeding towel webs from a primary roll in a first station, and a secondary roll in a second station, towel feed mechanism including a pair of parallel shafts having at least one pair of cylindrical web gripping and feeding surfaces providing a feed nip for paper webs delivered from rolls in said stations and being located inboard of the lateral edges of a paper web engaged in said feed nip, drive means for rotating one of said shafts, mounting means for a primary paper roll in said first station with the primary roll web extended through said feed nip to effect dispensing of said primary roll web, mounting means for a secondary roll in said second station with the secondary roll web lying in a path extended past said parallel shafts in spaced relation to the input side of said feed nip, a portion of one of said shafts in the end region thereof outboard of said web feeding surfaces and of the feed nip being of smaller diameter than the cylindrical feeding surface on said one shaft, and said outboard portion of said one shaft being threaded, a thread follower element mounted at the outer side of said extended path of the secondary roll web in the region of the threaded portion of said one shaft, the follower element being mounted for shifting movement axially of said threaded portion, and means responsive to exhaustion of the primary roll web to shift the thread follower element into engagement with the thread with the marginal edge portion of the secondary roll web therebetween and thereby cause the secondary roll web to enter the feed nip.

2. A towel dispenser as defined in claim 1 in which the thread on said threaded portion of said one shaft has a pitch angle providing for shifting of the follower element in a direction toward the edge of the paper web.

3. A towel dispenser as defined in claim 2 and further including yielding bias means tending to move the thread follower element in a direction opposite to the direction imparted to the follower element by the thread.

4. A towel dispenser as defined in claim 2 in which a threaded portion and a thread follower element are provided toward each end of said one shaft, the pitch angle of the threads providing for movement of the follower elements in directions away from each other.

5. A towel dispenser as defined in claim 1 in which the thread follower element comprises a rotative roller the periphery of which is engageable with said thread.

6. A towel dispenser as defined in claim 5 in which said one shaft has a portion offset outboard of the thread and which is of diameter less than that of the base of said thread and in which said roller is delivered from the outer end of said thread onto said outboard offset portion of the said one shaft.

7. A towel dispenser for sequentially feeding towel webs from a primary roll in a first station, and a secondary roll in a second station, towel feed mechanism including a pair of parallel shafts having at least one pair of cylindrical web gripping and feeding surfaces providing a feed nip for paper webs delivered from rolls in said stations and being located inboard of the lateral edges of a paper web engaged in said feed nip, drive means for rotating one of said shafts, mounting means for a primary paper roll in said first station with the primary roll web extended through said feed nip to effect dispensing of said primary roll web, mounting means for a secondary roll in said second station with the secondary roll web lying in a path extended past said parallel shafts in spaced relation to the input side of said feed nip, and mechanism for gripping the marginal edge portions of the secondary roll web outboard of the cylindrical feeding surfaces, said mechanism providing for laterally tensioning the secondary roll web and for bringing the laterally tensioned web into said feed nip.

8. A towel dispenser for sequentially feeding towel webs from a primary roll in a first station, and a secondary roll in a second station, towel feed mechanism including a pair of parallel shafts having cylindrical web gripping and feeding surfaces providing a feed nip for paper webs delivered from rolls in said stations, drive means for rotating one of said shafts, mounting means for a primary paper roll in said first station with the primary roll web extended in a path to said feed nip to effect dispensing of said primary roll web, mounting means for a secondary roll in said second station with the secondary roll web lying in a path extended past said parallel shafts in spaced relation to the input side of said feed nip, and mechanism for effecting transfer of web feed from a primary roll to a secondary roll upon exhaustion of the primary roll web, said transfer mechanism including a roll support for the primary roll shiftably movable in either direction generally in the path in which the primary roll web is extended toward the feed rolls, a transfer element for initiating feed of the secondary roll web by the towel feed mechanism, the transfer element being connected and movable with the shiftably movable primary roll support, biasing means tending to shift the primary roll support in the direction to effect transfer by said transfer element, and stop means positioned to engage the periphery of a primary roll carried by said support and located to limit shifting movement of the support in the direction to effect transfer by said transfer element, the stop means being positioned to limit movement of the support in said direction until the primary roll is close to exhaustion.

9. A towel dispenser for sequentially feeding towel webs from a primary roll in a first station, and a secondary roll in a second station, towel feed mechanism including a pair of parallel shafts having cylindrical web gripping and feeding surfaces providing a feed nip for paper webs delivered from rolls in said stations, drive means for rotating one of said shafts, mounting means for a primary paper roll in said first station with the primary roll web extended in a path to said feed nip to effect dispensing of said primary roll web, mounting means for a secondary roll in said second station with the secondary roll web lying in a path extended past said parallel shafts in spaced relation to the input side of said feed nip, and mechanism for effecting transfer of web feed from a primary roll to a secondary roll upon exhaustion of the primary roll web, said transfer mechanism including a roll support for the primary roll pivotally movable in either direction toward and away from the feed rolls, a transfer element for initiating feed of the secondary roll web by the towel feed mechanism, the transfer element being connected and movable with the pivotally movable primary roll support, biasing means tending to shift the primary roll support in the direction to effect transfer by said transfer element, and stop means positioned to engage the periphery of a primary roll carried by said support and located to limit shifting movement of the support in the direction to effect transfer by said transfer element, the stop means being positioned to limit movement of the support in said direction until the primary roll is close to exhaustion.

10. A towel dispenser as defined in claim 9 in which the pivotally movable roll support for a primary roll has a pivot axis offset from the axis of a primary roll carried by said primary roll support, the offset being in a direction generally opposite to the side of a primary roll from which the web is extended toward the towel feed mechanism.

11. A towel dispenser for use with towel rolls having hollow cores, the dispenser providing for sequentially feeding towel webs from a primary roll in a first or primary roll station, and a secondary roll in a second station, towel feed mechanism including a pair of parallel shafts having cylindrical web gripping and feeding surfaces providing a feed nip for paper webs delivered from rolls in said stations, drive means for rotating one of said shafts, mounting means for a primary paper roll in said first station with the primary roll web extended in a path to said feed nip to effect dispensing of said primary roll web, mounting means for a secondary roll in said second station with the secondary roll web lying in a path extended past said parallel shafts in spaced relation to the input side of said feed nip, mechanism for effecting transfer of web feed from a primary roll to a secondary roll upon exhaustion of the primary roll web, and a roll support device for mounting a roll in the primary station, said device comprising a cup-shaped element of diameter adapted to fit into the end of a roll core and having an external projection adapted to abut the end of the core, said abutment being located intermediate the ends of the cup-shaped element, the element being invertible end-for-end, and means for mounting the base of the cup alternatively in either inverted position and thereby provide for alternative support of rolls of different length.

12. A towel dispenser for sequentially feeding towel webs from a primary roll in a first station, and a secondary roll in a second station, towel feed mechanism including a pair of parallel shafts having cylindrical web gripping and feeding surfaces providing a feed nip for paper webs delivered from rolls in said stations, drive means for rotating one of said shafts, mounting means for a primary paper roll in said first station with the primary roll web extended in a path to said feed nip to effect dispensing of said primary roll web, mounting means for a secondary roll in said second station with the secondary roll web lying in a path extended to the feed nip, mechanism for effecting transfer of web feed from a primary roll to a secondary roll upon exhaustion of the primary roll web, and means for limiting the size of roll which may be transferred from the secondary station to the primary station comprising a limiting wall or abutment in spaced relation to one of the shafts of the feed mechanism, the spaced wall and shaft bridging the primary roll station and limiting the roll size insertable into the primary station.

13. A towel dispenser as defined in claim 12 in which said shaft of the feed mechanism rotates in a direction tending to eject a roll from the primary station in the event of attempted forceful insertion of an oversized roll between said shaft and limiting abutment.

14. A towel dispenser for sequentially feeding towel webs from a primary roll in a first station, and a secondary roll in a second station, towel feed mechanism including a pair of parallel shafts having at least one pair of cylindrical web gripping and feeding surfaces providing a feed nip for paper webs delivered from rolls in said stations and being located inboard of the lateral edges of a paper web engaged in said feed nip, drive means for rotating one of said shafts, mounting means for a primary paper roll in said first station with the primary roll web extended through said feed nip to effect dispensing of said primary roll web, mounting means for a secondary roll in said second station with the secondary roll web lying in a path extended past said parallel shafts in spaced relation to the input side of said feed nip, a portion of one of said shafts in the end region thereof outboard of said web feeding surfaces and of the feed nip being of smaller diameter than the cylindrical feeding surface on said one shaft, and said outboard portion of said one shaft being threaded, a thread follower element mounted at the outer side of said extended path of the secondary roll web in the region of the threaded portion of said one shaft, means providing for alternative mounting of rolls of webs of at least two different widths with an edge of any such web passing the threaded portion of said one shaft intermediate the ends of the threaded portion, the follower element being mounted for shifting movement axially of said threaded portion, and means responsive to exhaustion of the primary roll web to shift the thread follower element into engagement with the thread inboard of the edge of the web and with the marginal edge portion of the secondary roll web therebetween and thereby cause the secondary roll web to enter the feed nip.

15. A towel dispenser for sequentially feeding towel webs from a primary roll in a first station, and a secondary roll in a second station, towel feed mechanism including a pair of parallel shafts having at least one pair of cylindrical web gripping and feeding surfaces providing a feed nip for paper webs delivered from rolls in said stations and being located inboard of the lateral edges of a paper web engaged in said feed nip, drive means for rotating one of said shafts, mounting means for a primary paper roll in said first station with the primary roll web extended through said feed nip to effect dispensing of said primary roll web, mounting means for a secondary roll in said second station with the secondary roll web lying in a path extended past said parallel shafts in spaced relation to the input side of said feed nip, the mounting means for the primary roll being movably mounted toward one side of one of said shafts, bias means acting on said mounting means to move the primary roll toward said one shaft, and transfer mechanism for introducing the web of a secondary roll in the feed nip upon exhaustion of the web of the primary roll, the transfer mechanism being mounted to move with the movable mounting means for the primary roll.

* * * * *